US011504985B2

(12) United States Patent
Ito et al.

(10) Patent No.: US 11,504,985 B2
(45) Date of Patent: Nov. 22, 2022

(54) RECORDING APPARATUS

(71) Applicant: Seiko Epson Corporation, Tokyo (JP)

(72) Inventors: Tatsuya Ito, Shiojiri (JP); Kensuke Tamai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/346,345

(22) Filed: Jun. 14, 2021

(65) Prior Publication Data

US 2021/0387462 A1 Dec. 16, 2021

(30) Foreign Application Priority Data

Jun. 16, 2020 (JP) ..... JP2020-103563

(51) Int. Cl.

| | |
|---|---|
| ***B41J 11/00*** | (2006.01) |
| ***B41J 13/03*** | (2006.01) |
| ***B41J 13/00*** | (2006.01) |
| ***B41J 11/64*** | (2006.01) |
| ***B41J 3/407*** | (2006.01) |
| *B41J 13/12* | (2006.01) |

(52) U.S. Cl.

CPC ..... *B41J 11/008* (2013.01); *B41J 3/407* (2013.01); *B41J 11/0095* (2013.01); *B41J 11/64* (2013.01); *B41J 13/0009* (2013.01); *B41J 13/03* (2013.01); *B41J 3/4071* (2013.01); *B41J 13/12* (2013.01); *B41J 2203/011* (2020.08)

(58) Field of Classification Search

CPC ..... B41J 11/008; B41J 3/407; B41J 11/0095; B41J 11/64; B41J 13/0009; B41J 13/03; B41J 3/4071; B41J 13/12; B41J 2203/011

See application file for complete search history.

(56) References Cited

U.S. PATENT DOCUMENTS

| | | | | |
|---|---|---|---|---|
| 2004/0066441 | A1* | 4/2004 | Jones | B41J 11/0015 347/101 |
| 2005/0189066 | A1* | 9/2005 | Look | B41J 13/12 156/308.2 |
| 2009/0269116 | A1* | 10/2009 | Komuro | B41J 3/4071 399/405 |
| 2020/0039240 | A1 | 2/2020 | Fujisaki et al. | |
| 2020/0039241 | A1 | 2/2020 | Aoyagi et al. | |
| 2020/0039242 | A1 | 2/2020 | Ota et al. | |

(Continued)

FOREIGN PATENT DOCUMENTS

| | | |
|---|---|---|
| JP | 2019-191837 | 10/2019 |
| JP | 2020-019223 | 2/2020 |
| JP | 2020-019224 | 2/2020 |

(Continued)

*Primary Examiner* — Henok D Legesse

(74) *Attorney, Agent, or Firm* — Workman Nydegger

(57) ABSTRACT

A recording apparatus includes a control unit that acquires information regarding shapes and sizes of a recording material and a transport material to which the recording material is to be bonded. The control unit is configured to operate in a first recording mode in which a positioning pattern is recorded on the transport material, the positioning pattern being used to position the recording material on the transport material, and also configured to operate in a second recording mode in which the data is recorded on the recording material positioned on the transport material during transport of the transport material.

17 Claims, 12 Drawing Sheets

(56) References Cited

U.S. PATENT DOCUMENTS

| | | | |
|---|---|---|---|
| 2020/0039252 | A1 | 2/2020 | Ota et al. |
| 2020/0039773 | A1 | 2/2020 | Fujino |

FOREIGN PATENT DOCUMENTS

| | | |
|---|---|---|
| JP | 2020-019228 | 2/2020 |
| JP | 2020-019229 | 2/2020 |
| JP | 2020-019230 | 2/2020 |
| JP | 2020-019233 | 2/2020 |
| JP | 2020-019234 | 2/2020 |
| JP | 2020-019239 | 2/2020 |
| JP | 2020-019629 | 2/2020 |

* cited by examiner

FIG. 12

| TYPE OF RECORDING MATERIAL | TYPE OF TRANSPORT MATERIAL | TRANSPORT METHOD RELATED TO: | RECORDING METHOD RELATED TO: | PG RELATED TO: |
|---|---|---|---|---|
| a1 | b1 | b1 | a1 | a1 + b1 |
| | b2 | b2 | a1 | a1 + b2 |
| | b3 | b3 | a1 | a1 + b3 |
| a2 | b1 | b1 | a2 | a2 + b1 |
| | b2 | b2 | a2 | a2 + b2 |
| | b3 | b3 | a2 | a2 + b3 |
| a3 | b1 | b1 | a3 | a3 + b1 |
| | b2 | b2 | a3 | a3 + b2 |
| | b3 | b3 | a3 | a3 + b3 |

RECORDING APPARATUS

The present application is based on, and claims priority from JP Application Serial Number 2020-103563, filed Jun. 16, 2020, the disclosure of which is hereby incorporated by reference herein in its entirety.

BACKGROUND

1. Technical Field

The present disclosure relates to a recording apparatus that records data on a recording material.

2. Related Art

JP-A-2020-019228 discloses a recording apparatus that transports a tray on which an adapter retaining a recording medium is placed and then records data on the recording medium. In this case, the recording medium may be a nail seal, a card, or a disc.

The above recording apparatus disadvantageously involves using a dedicated adapter and tray, which may increase product cost and complicate user's handling. Moreover, if the dedicated adapter or tray is lost or damaged, the recording apparatus may be no longer able to record data on a medium.

SUMMARY

According to an aspect of the present disclosure, a recording apparatus includes: a recording unit that records data on a recording material; a transport unit that transports a transport material, the transport material having a larger size than that of the recording material at least in a transport direction; and a control unit that controls both the recording unit and the transport unit. The control unit acquires information regarding shapes and sizes of the recording material and the transport material. The control unit is configured to operate in a first recording mode in which a positioning pattern is recorded on the transport material, the positioning pattern being used to position the recording material on the transport material, and also configured to operate in a second recording mode in which the data is recorded on the recording material positioned on the transport material, during transport of the transport material.

According to another aspect of the present disclosure, a recording apparatus includes: a recording unit that records data on a recording material; a transport unit that transports a transport material, the transport material having a larger size than that of the recording material at least in a transport direction; a control unit that controls both the recording unit and the transport unit; and a scanning unit that scans the transport material on which the recording material is positioned. The control unit acquires information regarding shapes and sizes of the recording material and the transport material and information regarding a position of the recording material relative to the transport material, based on scan information received from the scanning unit. The control unit is configured to operate in a recording mode in which the data is recorded on the recording material based on the acquired information, during transport of the transport material.

BRIEF DESCRIPTION OF THE DRAWINGS

FIG. 12 is a table that lists the relationship between each of a transport method, a recording method, and a PG and the combination of types of a recording material and a transport material.

DESCRIPTION OF EXEMPLARY EMBODIMENTS

Figure 1:
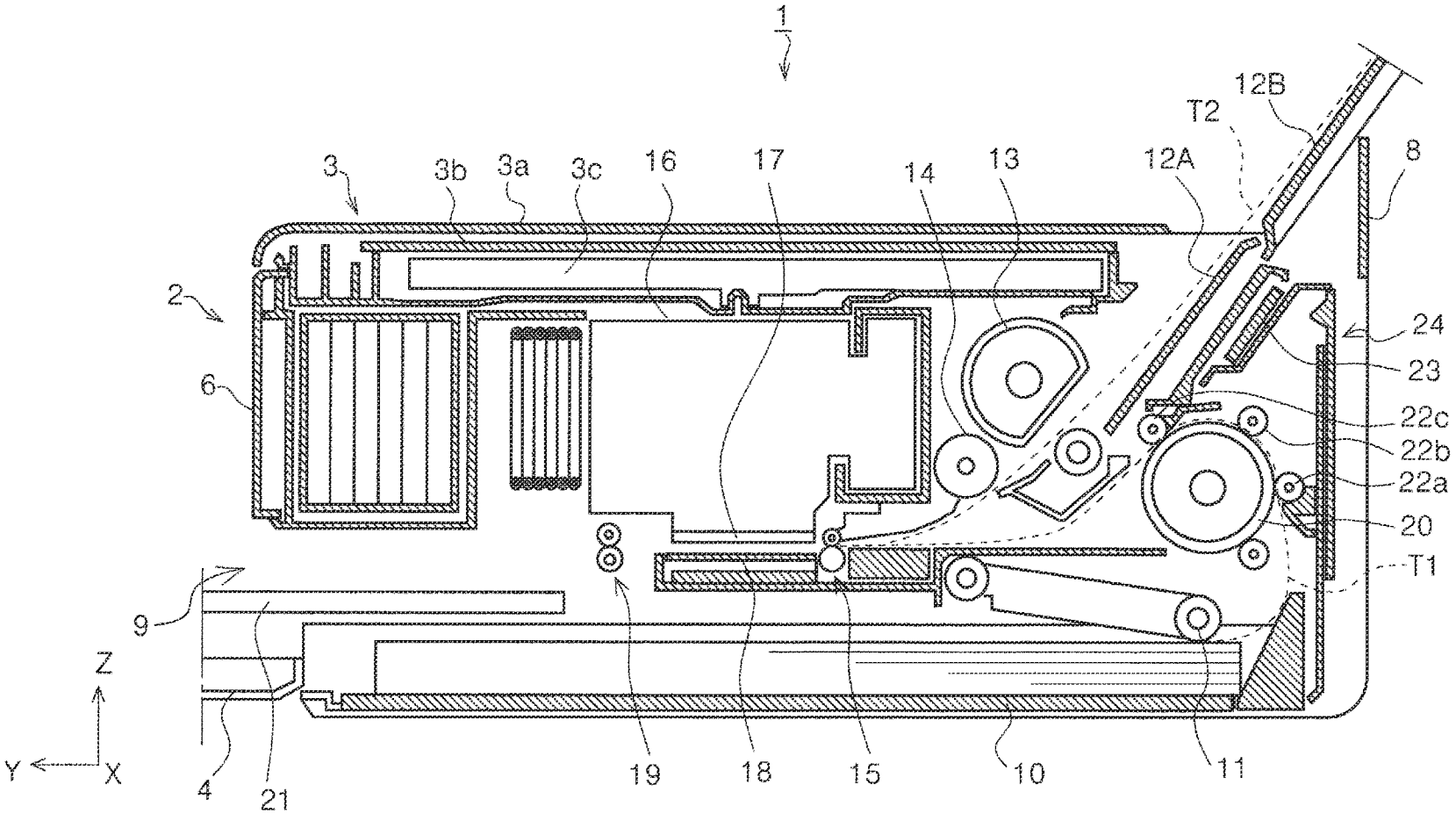
FIG. 1 schematically illustrates routes in a printer according to embodiments of the present disclosure, along which a medium is to be transported.

Some embodiments of the present disclosure will be described below briefly.

According to a first aspect of the present disclosure, a recording apparatus includes: a recording unit that records data on a recording material; a transport unit that transports a transport material, the transport material having a larger size than that of the recording material at least in a transport direction; and a control unit that controls both the recording unit and the transport unit. The control unit acquires information regarding shapes and sizes of the recording material and the transport material. The control unit is configured to operate in a first recording mode in which a positioning pattern is recorded on the transport material, the positioning pattern being used to position the recording material on the transport material, and also configured to operate in a second recording mode in which the data is recorded on the recording material positioned on the transport material, during transport of the transport material.

In the above aspect, after having acquired information regarding shapes and sizes of the recording material and the transport material, the control unit in the recording apparatus is configured to operate in a first recording mode in which a positioning pattern is recorded on the transport material, the positioning pattern being used to position the recording material on the transport material, and also configured to operate in a second recording mode in which the data is recorded on the recording material positioned on the transport material, during transport of the transport material. This configuration successfully utilizes a general-purpose product, such as a plain paper or a similar sheet material, for the printing apparatus as the transport material without using a dedicated tray or adapter, thereby providing great convenience to a user at low product cost.

The recording apparatus according to a second aspect of the present disclosure may include a detector disposed opposite the transport material transported by the transport in addition to the components in the first aspect. The control unit may control the recoding unit to record an identification pattern within an inner area of the positioning pattern during an operation in the first recording mode, may determine whether the identification pattern is present, based on a detection result of the detector before an operation in the second recording mode, and when detecting the identification pattern, may cancel the operation in the second recording mode and perform an error process.

If the control unit operates in the second recording mode with no recording material present on the positioning pattern that has been recorded on the transport material during the operation in the first recording mode, the recording apparatus may accidentally pollute or damage the transport material. In the above aspect, however, the control unit may control the recording unit to record an identification pattern within an inner area defined by the outline of the recording material during an operation in the first recording mode and may use the detector to determine whether the identification pattern is present, based on a detection result of the detector before an operation in the second recording mode. When detecting the identification pattern, the control unit may cancel the operation in the second recording mode and perform an error process. This configuration successfully suppresses the recording apparatus to accidentally pollute or damage the transport material.

According to a third aspect of the present disclosure, the recording apparatus may include a detector disposed opposite the transport material transported by the transport unit in addition to the components in the first aspect. The control unit may control the recoding unit to record an identification line on the transport material during an operation in the first recording mode, the identification line extending in a direction intersecting the transport direction. The identification line may be recorded so that a first distance between the identification line and a front edge of the transport material in the transport direction differs from a second distance between the identification line and a rear edge of the transport material in the transport direction and so that the identification line is positioned nearer the front edge than is the positioning pattern. The control unit may determine a third distance between the identification line and the front edge of the transport material in the transport direction, based on a detection result of the detector, before an operation in the second recording mode. When a difference between the first distance and the third distance exceeds an allowable value, the controller may suspend the operation in the second recording mode and perform a predetermined process.

If the transport material is transported while placed in an orientation unintended for the control unit, the recording apparatus may provide an improper recording result for a user; on the contrary, it might pollute or damage the transport material or waste the recording material. In the above aspect, however, the control unit may control the recording unit to record an identification line on the transport material during an operation in the first recording mode, the identification line extending in a direction intersecting the transport direction. The identification line may be recorded so that a first distance between the identification line and a front edge of the transport material in the transport direction differs from a second distance between the identification line and a rear edge of the transport material in the transport direction and so that the identification line is positioned nearer the front edge than the positioning pattern. Furthermore, the control unit may detect a third distance between the identification line and the front edge of the transport material in the transport direction, based on a detection result of the detector, before an operation in the second recording mode. When a difference between the first distance and the third distance exceeds an allowable value, the controller may suspend the operation in the second recording mode and perform a predetermined process. This configuration successfully reduces the risk of an occurrence of the above disadvantage.

According to a fourth aspect of the present disclosure, a recording apparatus includes: a recording unit that records data on a recording material; a transport unit that transports a transport material, the transport material having a larger size than that of the recording material at least in a transport direction; a control unit that controls both the recording unit and the transport unit; and a scanning unit that scans the transport material on which the recording material is positioned. The control unit acquires information regarding shapes and sizes of the recording material and the transport material and information regarding a position of the recording material relative to the transport material, based on scan information received from the scanning unit. The control unit is configured to operate in a recording mode in which the data is recorded on the recording material based on the acquired information, during transport of the transport material.

In the above aspect, the control unit in the recording apparatus may acquire information regarding shapes and sizes of the recording material and the transport material and information regarding a position of the recording material relative to the transport material, based on information obtained by using the scanning unit to scan the transport material on which the recording material is positioned. Thus, the control unit is configured to operate in a recording mode in which the data is recorded on the recording material based on the acquired information during transport of the transport material. Consequently, this configuration successfully utilizes a general-purpose product, such as a plain paper or a similar sheet material, for the printing apparatus as the transport material without using a dedicated tray or adapter, thereby providing great convenience to a user at low product cost.

According to a fifth aspect of the present disclosure, in the recording apparatus that includes the components in one of the first to fourth aspects, the control unit may acquire information regarding types of the recording material and the transport material and may set at least one of a transport method performed by the transport unit, a recording method performed by the recording unit, and a distance between the recording unit and the recording material, based on the types of the recording material and the transport material.

In the above aspect, the control unit may acquire information regarding types of the recording material and the transport material and may set at least one of a transport method performed by the transport unit, a recording method performed by the recording unit, and a distance between the recording unit and the recording material, based on the types of the recording material and the transport material. This configuration successfully provides sufficiently high recording quality.

According to a sixth aspect of the present disclosure, the recording apparatus may include, in addition to the components in one of the first to fourth aspects, a plurality of transport routes along which the transport material is to be transported. The control unit may acquire information regarding types of the recording material and the transport material and may generate a user interface that designates a suitable one of the transport routes, based on the types of the recording material and the transport material.

In the above aspect, the recording apparatus may include a plurality of transport routes along which the transport material is to be transported. The control unit may acquire information regarding types of the recording material and the transport material and may generate a user interface that designates a suitable one of the transport routes, based on the types of the recording material and the transport material. This configuration successfully transports the transport material along a suitable transport route, thereby providing a proper recording result.

According to a seventh aspect of the present disclosure, in the recording apparatus that includes the components in one of the first to sixth aspects, the recording material may be an optical disc, a card, or a seal.

In the above aspect, the recording material that may be an optical disc, a card, or a seal successfully produces effects one of the first to sixth aspects.

According to an eighth aspect of the present disclosure, in the recording apparatus that includes the components in according to the first to sixth aspects, the transport unit may include a feed roller pair that feeds the transport material to the recording unit and an ejection roller pair that ejects the transport material. Further, a length of the recording material in the transport direction may be shorter than a distance between a nip point of the feed roller pair and a nip point of the ejection roller pair in the transport direction.

Next, a description will be given below in detail of a recording apparatus according to some embodiments of the present disclosure, with reference to the accompanying drawings. Herein, an ink jet printer 1, referred to below simply as a printer 1, is an example of the recording apparatus. Each individual drawing employs an X-Y-Z coordinate system. Further, the ±X-axial directions, which are along the width of the printer 1, correspond to the moving directions of the recording head 17. The ±Y-axial directions, which are along the depth of the printer 1, correspond to the transport directions of a recording medium. The +Y-axial direction is the direction from the rear to the front of the printer 1, whereas the −Y-axial direction is the direction from the front to the rear of the printer 1. In this embodiment, the surface of the printer 1 with an operation panel 6 may correspond to the front surface. The ±Z-axial directions are along the height of the printer 1. The +Z-axial direction corresponds to the upward direction, whereas the −Z-axial direction corresponds to the downward direction.

Herein, the side to which a recording medium is to transported is referred to below as the downstream, whereas the opposite side is referred to below as the upstream. With regard to a configuration of the printer 1, a medium is not limited to a "recording material" or a "transport material" to which the recording material is bonded, both of which will be described later. The medium may be a regular-sized sheet, such as an A4-sized sheet, which can be placed in a medium cassette 10 or an inclined support section 12A, both of which will be described later. Moreover, the medium may be one on which data can be recorded by the printer 1 and which can be transported in the printer 1. Herein, the data may be one or more letters, characters, number, images, marks, tables, and/or charts.

Figure 2:
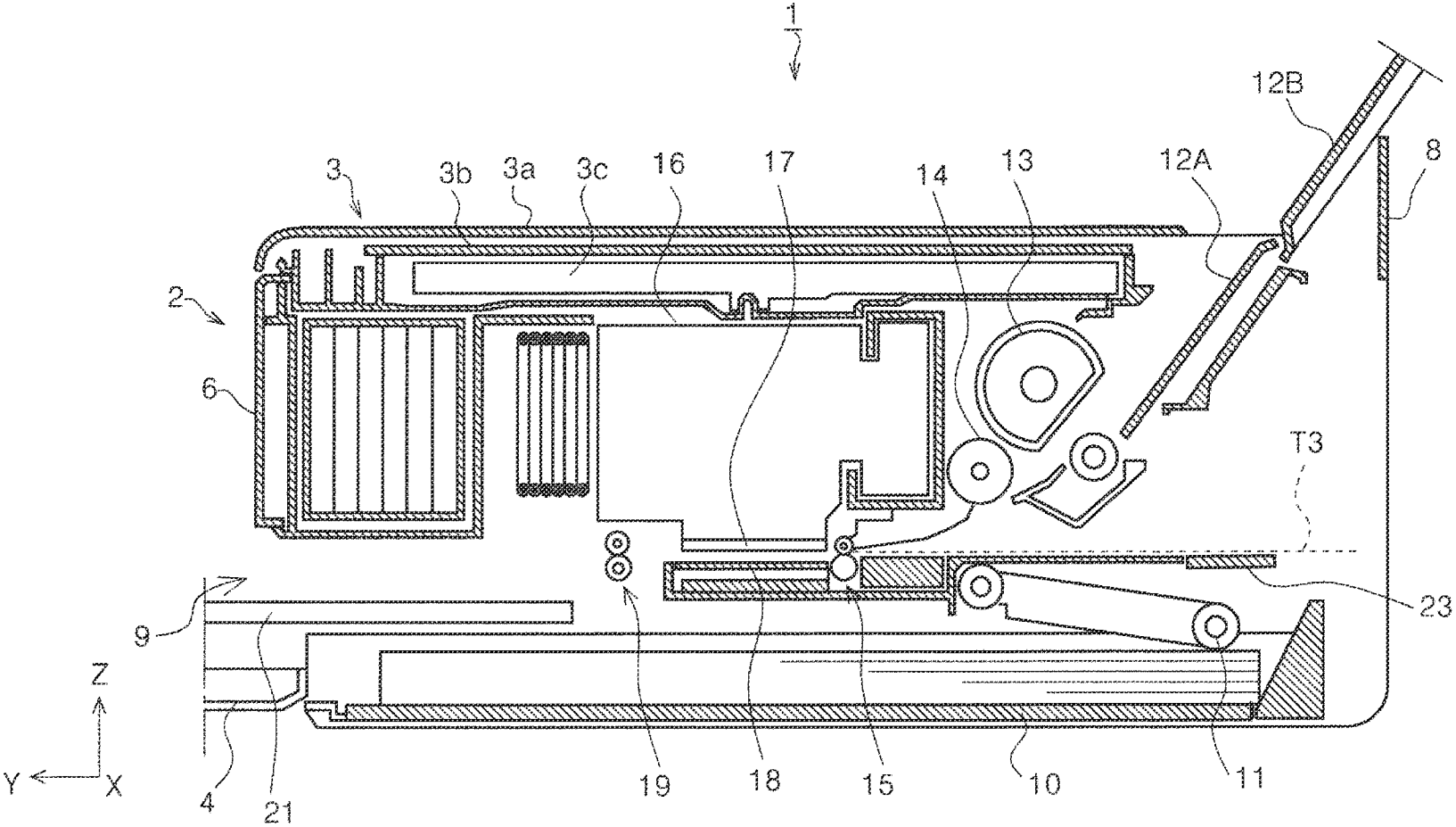
FIG. 2 schematically illustrates another route in the printer along which a medium is to be transported.

As illustrated in FIGS. 1 and 2, the printer 1 includes: a main body 2 in which data is recorded on a medium in an ink jet manner; and a scanner 3 disposed over the main body 2. In short, the printer 1 is an ink jet multifunction printer (MFP) that has both reading and recording functions. Herein, the scanner 3 is an example of an image reader. The scanner 3 is pivotable relative to the main body 2 so as to hide the main body 2 (see FIG. 1) or expose the main body 2 (not illustrated). The scanner 3 includes: a platen 3*b*; and a platen cover 3*a* that hides or exposes the platen 3*b*. Provided under the platen 3*b* is a read sensor 3*c*, which extends in the ±Y-axial directions and is movable in the ±X-axial directions by a sensor motor 3*d* (see FIG. 3). In this case, the scanner 3 may be a flat-bed type image reader.

The main body 2 is provided with the operation panel 6 on the front surface, which allows a user to perform various setting operations and displays recording settings and reviews of recorded images, for example. The operation panel 6, which may be implemented by a touch panel in this embodiment, realizes a user interface, abbreviated below as the UI, which displays various information and receives various setting operations from a user. In short, the operation panel 6 serves as a display unit in the printer 1 which displays various information. The UI displayed on the operation panel 6 assists the user in performing various setting and recording operations.

The main body 2 includes a front cover 4 on the front surface. By opening the front cover 4, the medium cassette 10, a medium ejection hole 9, a medium receiving tray 21, and some other components inside the main body 2 are exposed to the outside. The main body 2 further includes an upper cover 8 in an openable and closable manner. By opening the upper cover 8, the inclined support section 12A is exposed to the outside, and a support section extension 12B can be pulled out upward. The support section extension 12B is switchable between an accommodated state (not illustrated) and a usage state in which the support section extension 12B is extended in an inclined position, as illustrated in FIGS. 1 and 2.

The printer 1 has three medium transport routes: a medium transport route T1 extending from the medium cassette 10 disposed on the bottom of the main body 2 to a feed roller pair 15; a medium transport route T2 extending from an upper rear portion of the main body 2 to the feed roller pair 15; and a medium transport route T3 (see FIG. 2) extending from the rear center of the main body 2 to the feed roller pair 15. Each of the medium transport routes T1, T2, and T3 may be formed of a medium forming member, details of which will not be described herein.

When transported along the medium transport route T1, a medium is fed from the medium cassette 10 by a pick roller 11, turned around by an inversion roller 20, and delivered to the feed roller pair 15. Both of the pick roller 11 and the inversion roller 20 are driven by a transport motor 53 (see FIG. 3). Arranged on the outer circumference of the inversion roller 20 are driven rollers 22*a*, 22*b*, and 22*c*.

When transported along the medium transport route T2, a medium that has been supported in an inclined position by both the inclined support section 12A and the support section extension 12B is fed by a transport roller 13 and an auxiliary roller 14 and delivered to the feed roller pair 15. In short, the medium transport route T2 is used to transport the medium placed on an upper rear portion of the main body 2. Both of the transport roller 13 and the auxiliary roller 14 are driven by the transport motor 53 (see FIG. 3).

The medium transport route T3 is a route along which a medium that a user has manually inserted into the main body 2 is transported from the rear to the front. In this embodiment, the medium transport route T3 may extend horizontally in a substantially linear fashion. The medium transport route T3 can be formed by removing an inversion unit 24 from a rear portion of the main body 2, detaching an adapter 23 from the inversion unit 24, and attaching the adapter 23 to the main body 2 as illustrated in FIG. 2. The inversion unit 24 may be an assembly with the inversion roller 20.

Figure 3:
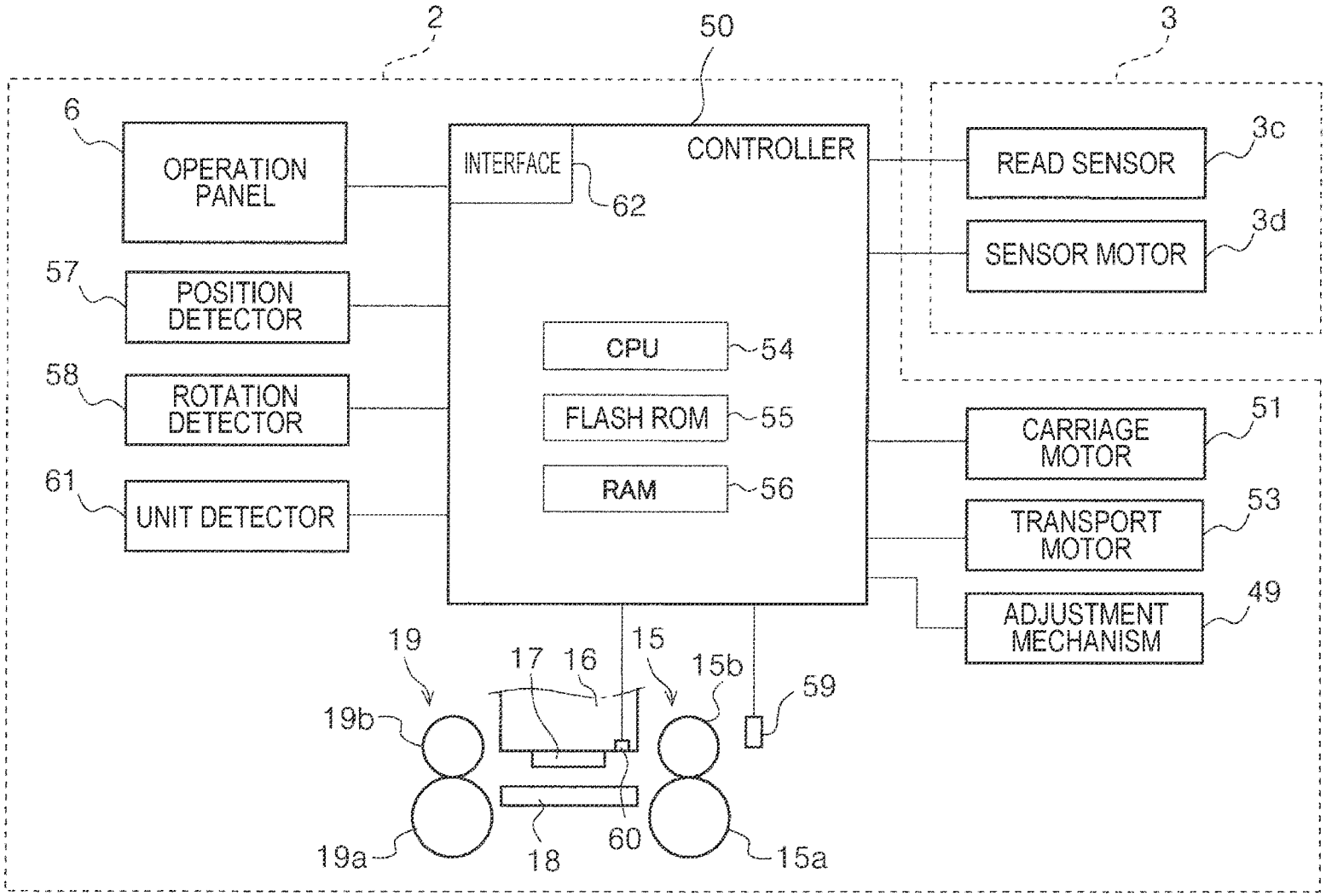
FIG. 3 is a block diagram of a control system in the printer.

The feed roller pair 15, which feeds a medium to a space defined opposite a recording head 17, includes a feed roller 15*a* and a nip roller 15*b*, as illustrated in FIG. 3. The feed roller 15*a* is driven by the transport motor 53 (see FIG. 3). The nip roller 15*b* is movable toward or away from the feed roller 15*a* and kept pressed against the feed roller 15*a* by a spring (not illustrated). The nip roller 15*b* is rotated by the rotation of the feed roller 15*a*, thereby feeding a medium nipped between the feed roller 15*a* and the nip roller 15*b*.

Arranged downstream of the feed roller pair 15 are the recording head 17 and a medium support section 18 so as to face each other. The medium support section 18 supports a medium and specifies a gap between the recording head 17 and the medium. The recording head 17 is disposed in a carriage 16, which reciprocates along the width of a medium, namely, is movable in the ±X-axial directions by a carriage motor 51 (see FIG. 3) under the control of a controller 50 (see FIG. 3). The carriage 16 is displaceable in the ±Z-axial directions by an adjustment mechanism 49 (see FIG. 3) under the control of the controller 50 (see FIG. 3) so that the adjustment mechanism 49 can adjust the distance between the recording head 17 and the medium support section 18. Thereinafter, the distance between the recording head 17 and the medium support section 18 is denoted by PG. For example, the adjustment mechanism 49 includes a motor and a cam mechanism, both of which are not illustrated.

Disposed on the downstream of both the recording head 17 and the medium support section 18 is an ejection roller pair 19. As illustrated in FIG. 3, the ejection roller pair 19 includes a feed roller 19*a* and a nip roller 19*b*. The feed roller 19*a* is driven by the transport motor 53 (see FIG. 3), whereas the nip roller 19*b* is movable toward or away from the feed roller 19*a* and kept pressed against the feed roller 19*a* by a spring (not illustrated). The nip roller 19*b* is rotated by the rotation of the feed roller 19*a*, thereby feeding a medium nipped between the feed roller 19*a* and the nip roller 19*b*. After data has been recorded on the medium, the medium is transported to the outside of the main body 2 by the ejection roller pair 19 and received by the medium receiving tray 21.

With reference to FIG. 3, a description will be given below of a control system in the printer 1. The controller 50 controls various operations performed in the printer 1, including the supply, transport, and ejection of media inside the main body 2, recording operations, and reading operations in the scanner 3. The controller 50 receives signals from the operation panel 6 and in turn transmits signals for realizing the UI to the operation panel 6.

The controller 50 controls the carriage motor 51, the transport motor 53, and the sensor motor 3*d*, each of which may be implemented by a direct current (DC) motor in this embodiment. In addition, the controller 50 receives detection signals from a position detector 57, a rotation detector 58, a first medium detector 59, a second medium detector 60, and a unit detector 61. The position detector 57, which may be implemented by a linear encoder, is a detector that detects a location of the carriage 16 in the +X-axial or −X-axial direction. The rotation detector 58, which may be implemented by a rotary encoder, is a detector that detects a frequency and rotational speed of the transport motor 53. The unit detector 61 is a detector that detects whether the inversion unit 24 (see FIG. 1) is attached to the main body 2.

The first medium detector 59, which is disposed on the upstream of and near the feed roller pair 15, is a detector that detects the passage of the front and rear edges of a medium. The second medium detector 60, which may be disposed opposite a medium in the carriage 16, is a detector that detects, for example, the edges of a medium in the +X-axial or −X-axial and the +Y-axial or −Y-axial directions. The second medium detector 60 may be implemented by an optical sensor that includes: a light emitter that emits detection light; and a light receiver that receives the detection light reflected on a medium. The first medium detector 59 may be implemented by a contact or noncontact type sensor. The sensor motor 3*d* in the scanner 3 is provided with an encoder (not illustrated) that serves as a rotation detector, which informs the controller 50 of a location of the read sensor 3*c* in the +X-axial or −X-axial direction.

The controller 50 includes a central processing unit (CPU) 54, flash read-only memory (ROM) 55, and random-access memory (RAM) 56. The CPU 54 performs various arithmetic processes in accordance with programs stored in the flash ROM 55 and controls various operations to be performed by the main body 2 and the scanner 3. The flash ROM 55, which corresponds to an example of a storage unit, may be implemented by a nonvolatility memory into which data can be written or from which data can be read. The flash ROM 55 stores various programs, parameters, and other data to be used to control both the main body 2 and the scanner 3. The flash ROM 55 also stores various setting information that has been supplied from the user through the operation panel 6. The RAM 56, which serves as a storage unit, temporarily stores various information. The controller 50 further includes an interface 62, via which the controller 50 can communicate with an external computer.

Figure 4:
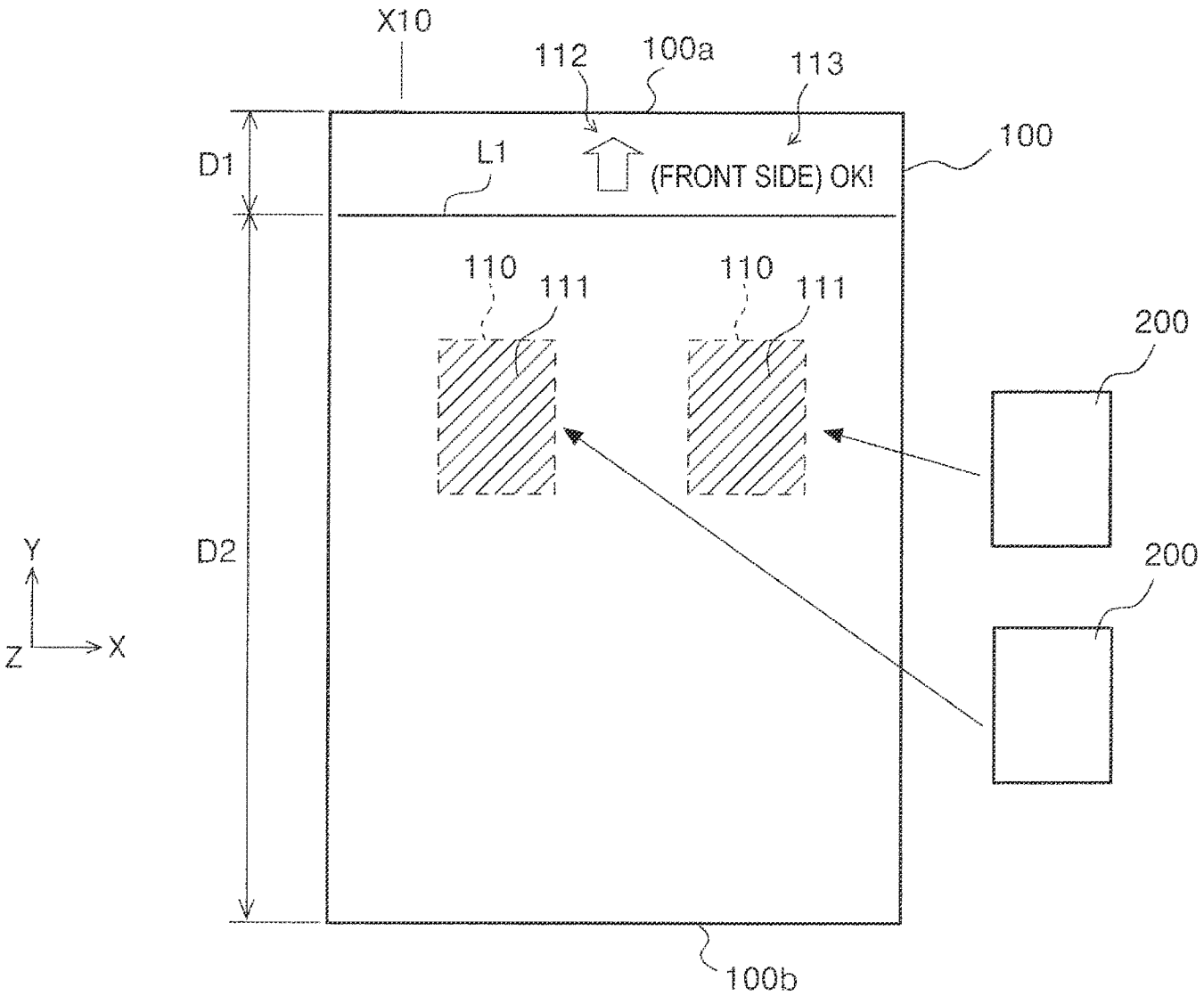
FIG. 4 is a plan view of an example of recording materials and positioning patterns recorded on a transport material.

With reference to FIG. 4, a description will be given of a method by which the printer 1 records data on a recording material in a case where the recording material has a small size and thus cannot be transported solely. In FIG. 4, the reference numerals 200 denote an example of recording materials on which data is to be recorded. In this case, the recording materials are assumed to have a so small size in the transport direction that it cannot be simultaneously nipped in both the feed roller pair 15 and the ejection roller pair 19, or have a so complicated outer shape that it cannot be transported solely and precisely with their orientations maintained. However, the recording materials are not limited to those having such sizes or shapes. Alternatively, the recording materials may have an enough length in the transport direction to be simultaneously nipped in both the feed roller pair 15 and the ejection roller pair 19, or may have simple outer shapes. Examples of the recording materials include optical discs, cards, and seals such as nail seals. In this case, for example, a seal includes: a seal body; and a mount to which the seal body is bonded; an optical disc is a compact disk (CD) or a digital video disc (DVD); and a card has a size and a shape conforming to international specifications such as those specified by ISO/IEC 7810.

When the printer 1 transports a recording material 200 solely along the medium transport route T2 or T3, if the length of the recording material 200 in the transport distance is shorter than the distance between the feed roller pair 15 and the ejection roller pair 19, the printer 1 may fail to eject the recording material 200 from the main body 2.

In FIG. 4, the reference numeral 100 denotes a transport material, the length of which at least in the transport direction is longer than the recording materials 200 and which can be simultaneously nipped in both the feed roller pair 15 and the ejection roller pair 19. For example, the transport material 100 is a standard-sized sheet owned by a user, such as an A4-sized plain paper sheet or picture sheet. Further, the transport material 100 may be a regular sheet, unlike a tray or an adapter dedicated to the printer 1. Since the printer 1 cannot transport the recording materials 200 inside the main body 2 solely because of their small size, a user needs to supply the printer 1 with the transport material 100 to which the recording materials 200 are bonded. Then, the printer 1 records data on the recording materials 200 while transporting the transport material 100.

Figure 5:
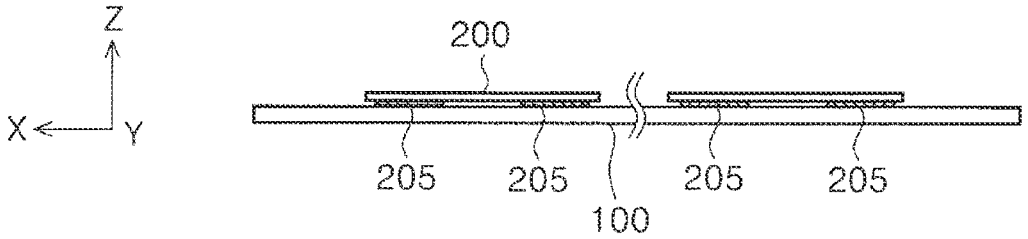
FIG. 5 is a side view of the transport material, the recording materials, and bonding materials.

In FIG. 5, the reference numerals 205 denote bonding materials that stick the recording materials 200 to the transport material 100. Each bonding material 205 may be a double-sided adhesive tape that can be used multiple times. However, each bonding material 205 may be any material that can maintain a recording material 200 on the transport material 100 over a period in which the printer 1 transports the transport material 100, records data on the recording materials 200, and ejects the transport material 100 from the main body 2. It should be noted that the bonding materials 205 are optional. If the bonding materials 205 are not used, at least one of a transport material 100 and a recording material 200 may be a magnetic material, and the recording material 200 may be magnetically attached to and maintained on the transport material 100.

A description will be given below of a specific method of recording data on the recording material 200.

First Embodiment

Figure 6:
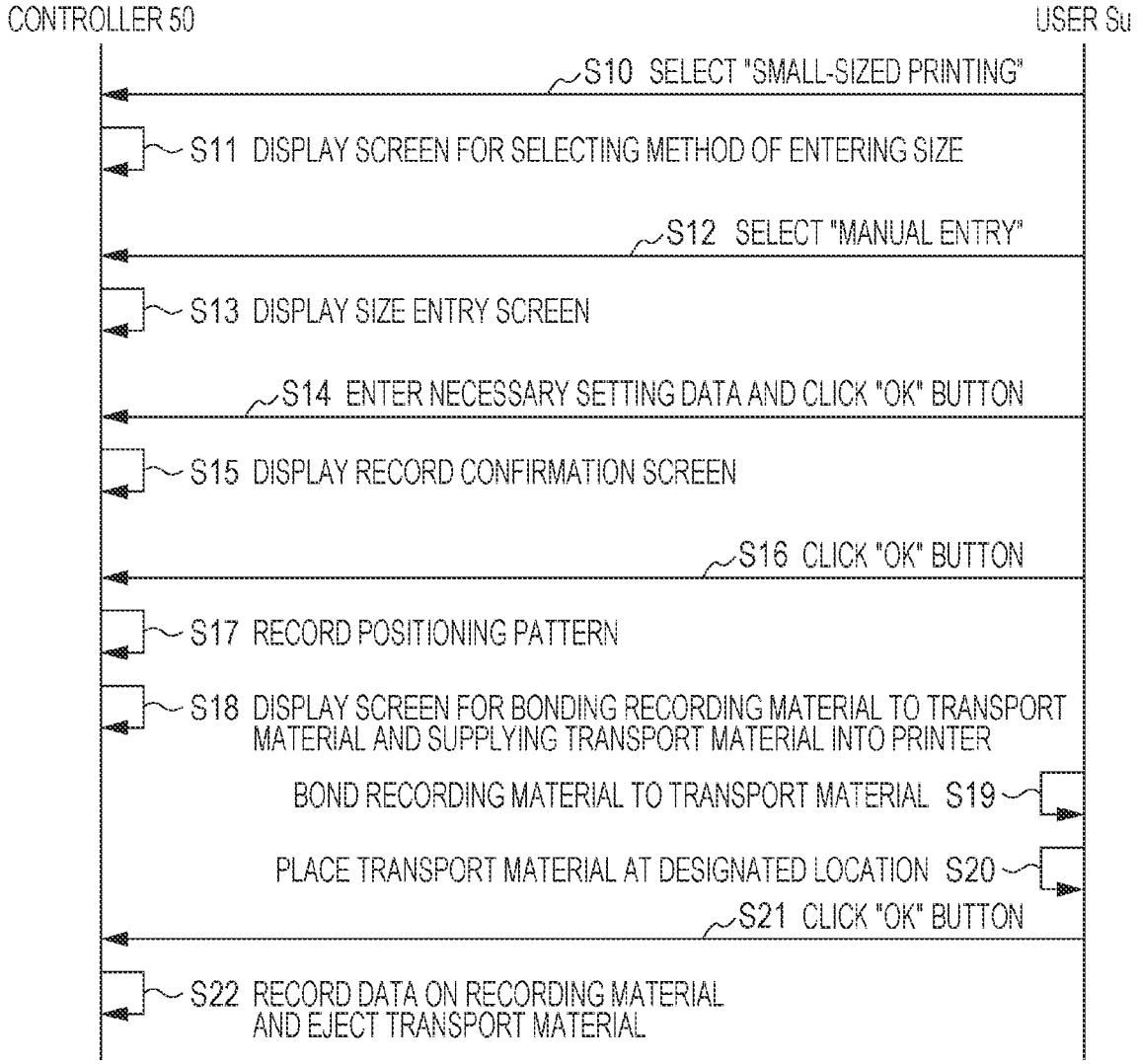
FIG. 6 is a sequence diagram of a control process according to a first embodiment of the present disclosure which the controller performs in response to user's operations.
Figure 7:
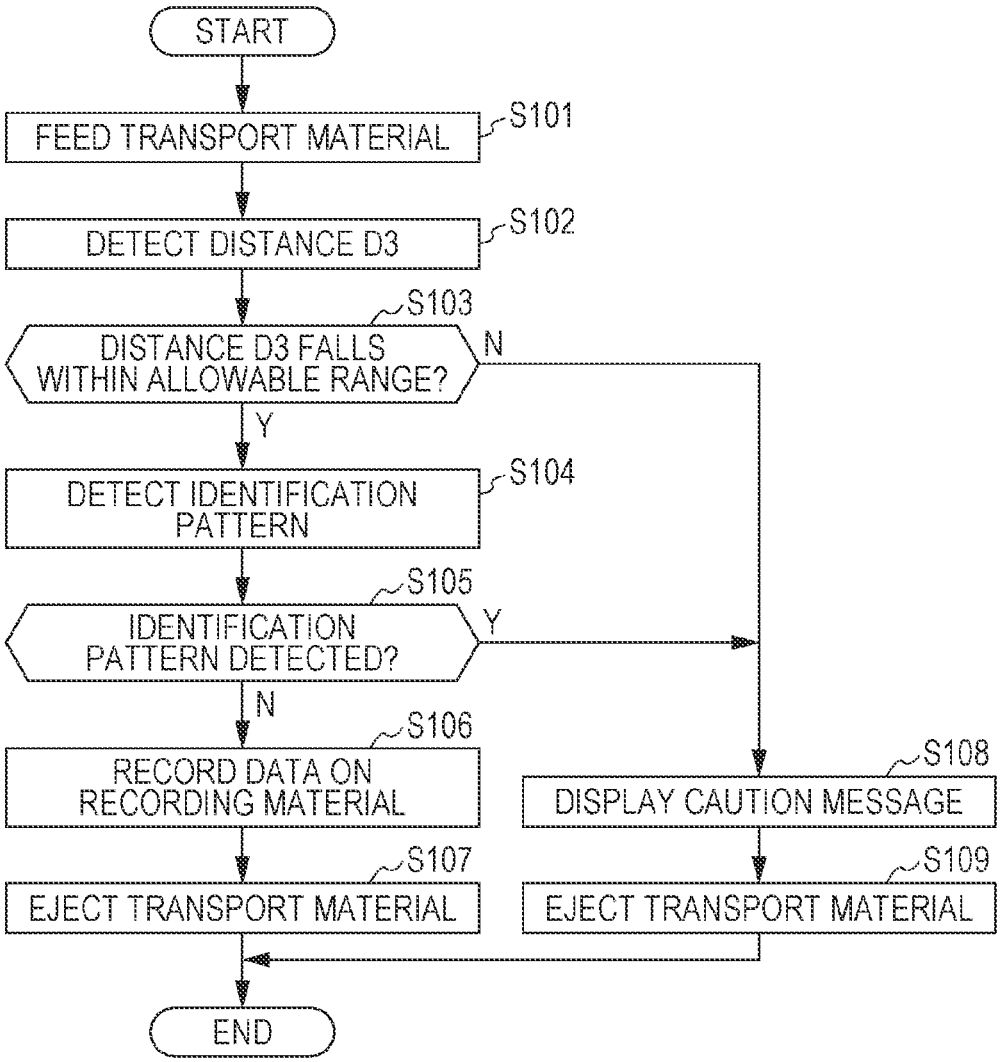
FIG. 7 is a flowchart of a control process according to the first embodiment which the controller performs.

With reference to FIGS. 6 and 7, a description will be given below of a method, according to a first embodiment, of recording data on the recording materials 200. In the first embodiment, each recording material 200 is expected to be a product having a specified size, such as an optical disc or a card, or a product having such a simple shape, such as a rectangular shape, that a user can enter its size relatively easily. If each recording material 200 is a product having a specified size, data on this size is assumed to be prestored in the controller 50.

In FIG. 6, at Step S10, a user Su selects the "small-sized printing" through the UI in the operation panel 6. In response, at Step S11, the controller 50 causes the operation panel 6 to display a screen for selecting a method of entering a size. In this and subsequent embodiments, the UI provided to the user Su is realized in the operation panel 6; however, the UI may be realized in a display unit of an external computer connected to the printer 1.

The user Su can select a preferred one from the "manual entry", the "scanning of recording material", and the "scanning of recording material and transport material" through the screen for selecting a method of entering a size, at Step S12. In the first embodiment, the user Su selects the "manual entry". In response, at Step S13, the controller 50 causes the operation panel 6 to display a size entry screen through which the user Su can enter various information. The size entry screen provides a UI through which the sizes of the recording materials 200 and the transport material 100 are defined. Furthermore, the size entry screen provides a UI through which the types of the recording materials 200 and the transport material 100 and recording quality are selected. Examples of the types of the recording materials 200 and the transport material 100 include "plain paper" and "glossy paper"; examples of the recording quality include "normal" and "high". The controller 50 will reflect the selected recording quality in the printer 1 at Step S22. Based on the selected types, the controller 50 estimates the thicknesses of the recording materials 200 and the transport material 100. Moreover, the size entry screen provides a UI through which the number of recording materials 200 are bonded to the transport material 100. At Step S14, the user Su enters necessary setting data through the size entry screen and then clicks the "OK" button.

In response to the above, at Step S15, the controller 50 causes the operation panel 6 to display a record confirmation screen. The record confirmation screen contains a message that encourages the user to place a transport material 100 on which recording materials 200 are not bonded, at a designated location and asks the user whether to have placed the transport material 100. The designated location at which the transport material 100 is to be placed may be either an upper rear or rear center of the printer 1 in this embodiment. If the designated location is the upper rear of the printer 1, the printer 1 will use the medium transport route T2 to transport the transport material 100. If the designated location is the rear location of the printer 1, the printer 1 will use the medium transport route T3 to transport the transport material 100.

In this and subsequent embodiments, the printer 1 does not use the medium transport route T1 to transport the transport material 100 when the recording materials 200 are not bonded on the transport material 100. The reason is that the recording materials 200 may peel off the transport material 100 and be stuck in the medium transport route T1 around the inversion roller 20 having a greater curvature than any other transport route inside the printer 1.

The controller 50 may inform the user Su of the designated location at which the transport material 100 is to be placed, based on the types of the recording materials 200 and the transport material 100. If all of the recording materials 200 and the transport material 100 are so flexible that it can be transported along any of the medium transport routes T2 and T3, the controller 50 may designate either the upper rear or the rear center as the designated locations for the transport material 100. If the recording materials 200 or the transport material 100 has high rigidity or if the transport material 100 has high rigidity with the recording materials 200 bonded thereon, the controller 50 may determine that the medium transport route T2 having a curved portion is unsuitable for a route along which the transport material 100 is transported and instead may designate the rear center as the designated location for the transport material 100. The information used for this determination is assumed to be prestored in the flash ROM 55 of the controller 50. In this way, the controller 50 acquires the information regarding the types of the recording materials 200 and the transport material 100 and then generates a UI that designates a suitable one of a plurality of transport routes, based on the acquired types of the recording materials 200 and the transport material 100.

In the first embodiment, the controller 50 may determine the designated location for the transport material 100, only based on the type of the transport material 100 because the recording materials 200 are not yet bonded at Step S15. However, the controller 50 more preferably determines the designated location for the transport material 100, based on both the types of the transport material 100 and the recording materials 200 even at Step S15. This is because it is possible to provide greater convenience to the user Su if he/she can place the transport material 100 at the same location, regardless of whether the recording materials 200 are bonded to the transport material 100.

At Step S16, the user Su places the transport material 100 at the designated location and then clicks the "OK" button. In response, at Step S17, the controller 50 records positioning patterns on the transport material 100. Herein, the recording of the positioning patterns may correspond to an example of an operation in a first recording mode. In FIG. 4, the reference numerals 110 denote an example of positioning patterns. In this embodiment, each of the positioning patterns 110 may be formed of broken lines along the outline of a corresponding recording material 200 to be bonded to the transport material 100. However, the positioning patterns 110 may be any patterns that can be used as landmarks to position the recording materials 200 on the transport material 100. In this case, the controller 50 needs to record the same number of positioning patterns 110 as the recording materials 200 to be bonded.

The controller 50 preferably records the positioning patterns 110 on the transport material 100 at such locations that it will be possible to record data on the recording materials 200 bonded to the transport material 100 when the transport material 100 is simultaneously nipped in both the feed roller pair 15 and the ejection roller pair 19. The reason is that, if the transport material 100 is nipped in only one of the feed roller pair 15 and the ejection roller pair 19, the distances between the recording head 17 and the individual recording materials 200 may vary from one another.

In this embodiment, the controller 50 further records the identification patterns 111 within the inner areas of the respective positioning patterns 110. In this embodiment, as an example, each identification pattern 111 is formed of hatching lines. However, each identification pattern 111 may be any pattern that enables the controller 50 to identify whether the recording materials 200 have already been bonded to the positioning pattern 110, details of which will be described later.

In this embodiment, the controller 50 further records an identification line L1 on the transport material 100. The identification line L1 extends in a direction intersecting the transport direction so that distances D1 and D2 differ from each other: the distance D1 is defined as that between the identification line L1 and a front edge 100*a* of the transport material 100 in the transport direction; and the distance D2 is defined as that between the identification line L1 and a rear edge 100*b* of the transport material 100 in the transport direction. In this case, the identification line L1 is recorded nearer the front edge 100*a* than the positioning patterns 110.

In this embodiment, the controller 50 further records an arrow mark 112 and identification letters 113: the arrow mark 112 indicates which side of the transport material 100 is front; and the identification letters 113 are a message informing the user Su that the arrow mark 112 indicates the front side of the transport material 100. In this embodiment, as an example, the identification letters 113 are "front side".

In addition to the arrow mark 112 and the identification letters 113, the controller 50 may further record, on the transport material 100, a caution message regarding the bonding of the recording materials 200, such as a message reading "bond recording material inside frame line". In addition, the controller 50 may further record a message about the designated location of the transport material 100, such as a message reading "bond recording materials and supply transport material into the printer 1 from the rear". Those messages may also be displayed in the operation panel 6.

At Step S18, the controller 50 causes the operation panel 6 to display a screen that encourages the user Su to bond the recording materials 200 to the transport material 100 and then supply the transport material 100 into the printer 1. In this case, the controller 50 encourages the user Su to place the transport material 100 at the designated location, based on the types of the recording materials 200 and the transport material 100, as described above.

At Step S19, the user Su bonds the recording materials 200 to the transport material 100. At Step S20, the user Su places the transport material 100 at the designated location. At Step S21, the user Su clicks the "OK" button. In response, at Step S22, the controller 50 feeds the transport material 100, records data on the recording materials 200, and ejects the transport material 100. Herein, the operation performed by the printer 1 at Step S22 is an example of an operation in a second recording mode in which the printer 1 records the data on the recording materials 200 positioned on and bonded to the transport material 100 while transporting the transport material 100.

With reference to FIG. 7, a description will be given below of a control process that the controller 50 performs in order to record the data on the recording materials 200. In response to an instruction of performing the recording operation at Step S21 in FIG. 6, at Step S101, the controller 50 starts feeding the transport material 100. At Step S102, the controller 50 uses the second medium detector 60 to detect a distance D3 between the identification line L1 and the front edge of the transport material 100 in the transport direction. In this case, for example, the controller 50 controls the carriage 16 in such a way that the second medium detector 60 is positioned at a location X10 in FIG. 4 in the +X-axial or −X-axial direction and then detects the distance D3 with the second medium detector 60 at the location X10 in the +X-axial or −X-axial direction. It should be noted that the front edge detected at Step S102 does not necessarily have to coincide with the front edge 100*a* in FIG. 4. For example, if the user Su places the transport material 100 in the opposite orientation by mistake, the front edge detected at Step S102 coincides with the rear edge 100*b* in FIG. 4.

At Step S103, the controller 50 determines whether the detected distance D3 falls within an allowable range. More specifically, the controller 50 determines whether the difference between the distance D1 in FIG. 4 and the distance D3 determined at Step S102 exceeds a predetermined allowable value. In this case, if the transport material 100 is placed in a correct orientation, the detected distance D3 nearly equates with the distance D1 that has been prestored as data. Therefore, the controller 50 determines that the transport material 100 is placed in a correct orientation (Yes at Step S103). As a result, the controller 50 selects Yes at Step S103 and proceeds to Step S104.

When determining that the determined distance D3 falls outside the predetermined allowable range (No at Step S103), the controller 50 determines that the transport material 100 is placed in a wrong orientation. Therefore, the controller 50 suspends the recording of the data on the recording materials 200 and performs a predetermined process. In this embodiment, the predetermined process is that the controller 50 causes the operation panel 6 to display a caution message at Step S108 and then ejects the transport material 100 at Step S109. This caution message may be a message reading "transport material is placed in wrong orientation". In this embodiment, the controller 50 suspends the recording of the data on the recording materials 200; however, the controller 50 will finally cancel the recording of the data on the recording materials 200.

In the above process, instead of canceling the recording of the data on the recording materials 200, the controller 50 may reprocess the recording data in accordance with the current orientation of the recording materials 200 and then records the resultant data on the recording materials 200.

At Step S104, the controller 50 uses the second medium detector 60 to detect the identification patterns 111 in FIG. 4. In this way, the controller 50 can locate the identification patterns 111 that the printer 1 has recorded on the transport material 100. When a recording material 200 is appropriately bonded to the transport material 100, the controller 50 cannot detect the identification pattern 111. When a recording material 200 is not correctly bonded to the transport material 100, the controller 50 can detect the identification pattern 111.

When detecting the identification patterns 111 (Yes at Step S105), the controller 50 causes the operation panel 6 to display a caution message at Step S108 and then ejects the transport material 100 at Step S109. If the controller 50 attempts to record the data on the identification patterns 111 in this case, the printer 1 may accidentally pollute or damage the transport material 100. This caution message may be a message reading "recording materials are not correctly bonded". When not detecting the identification patterns 111 (No at Step S105), the controller 50 records the data on the recording materials 200 at Step S106 and then ejects the transport material 100 at Step S107.

In the above case, the controller 50 already knows the locations of the positioning patterns 110 recorded on the transport material 100 when recording data on the recording material 200. Therefore, the controller 50 can use the first medium detector 59 or the second medium detector 60 to detect the front edge of the transport material 100 in the transport direction and then can record the data on the transport material 100 at the locations where the positioning patterns 110 are expected to be recorded. Moreover, the controller 50 may use the second medium detector 60 to detect a side edge of the transport material 100 and then may record the data on the transport material 100 at the locations where the positioning patterns 110 are expected to be recorded. Alternatively, the controller 50 may use the second medium detector 60 to directly detect the locations of the recording materials 200 and then may record the data, based on the detected locations.

It should be noted that the controller 50 do not necessarily have to form all of the identification patterns 111, the identification line L1, the arrow mark 112, and the identification letters 113, illustrated in FIG. 4, on the transport material 100. In other words, the controller 50 may skip the process of forming them as appropriate. If the identification line L1 is not formed, the controller 50 may use the second medium detector 60 to directly detect the recording material 200, thereby identifying the orientation of the transport material 100. For that purpose, the controller 50 preferably records the positioning patterns 110 on the transport material 100 in such a way that the distance between the front edge 100*a* and each positioning pattern 110 differs from that between the rear edge 100*b* and each positioning pattern 110.

Second Embodiment

Figure 8:
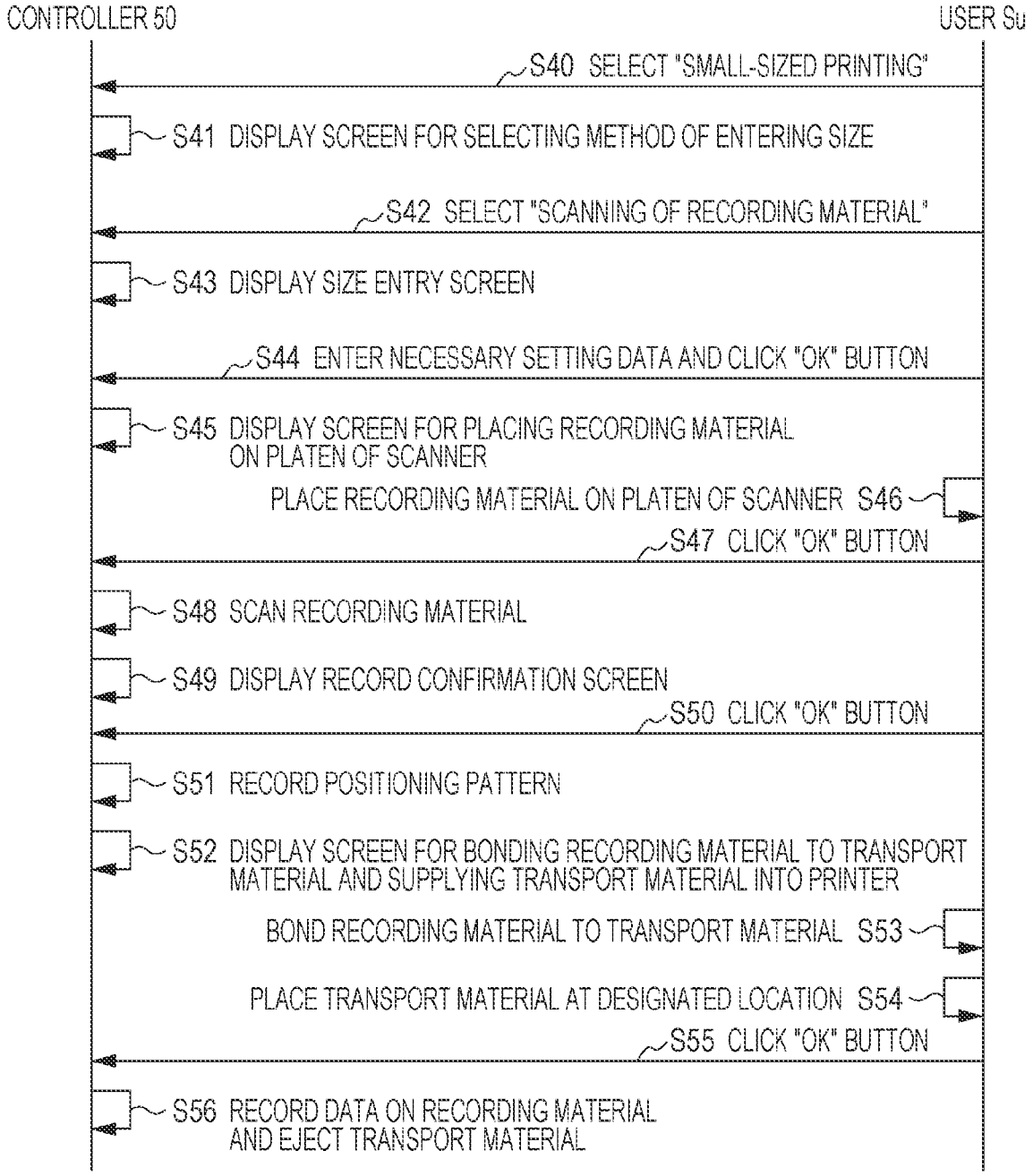
FIG. 8 is a sequence diagram of a control process according to a second embodiment of the present disclosure which the controller performs in response to user's operations.

With reference to FIG. 8, a description will be given below of a second embodiment of the present disclosure, which is another example of a method of forming information on a recording material. Unlike the foregoing first embodiment, the second embodiment is suitably applicable to the case where a recording material 200 does not have a specified size and shape. More specifically, this second embodiment is suitably applicable to the case where the recording material 200 does not has a simple rectangular shape but a complicated shape. However, it should be noted that the second embodiment is still applicable when the recording material 200 has a specified size and shape. In FIG. 8, at Step S40, a user Su selects the "small-sized printing" through a UI in an operation panel 6. In response, at Step S41, the controller 50 causes the operation panel 6 to display a screen for selecting a method of entering a size.

The user Su can select a preferred one from the "manual entry", the "scanning of recording material", and the "scanning of recording material and transport material" through the screen for selecting a method of entering a size. In the second embodiment, at Step S42, the user Su selects the "scanning of recording material". In response, at Step S43, the controller 50 causes the operation panel 6 to display a size entry screen through which the user Su can enter various information. The size entry screen provides a UI through which the size of a transport material 100 is defined. In this case, the user Su does not need to define the size of the recording materials 200. Furthermore, the size entry screen provides a UI through which the types of the recording materials 200 and the transport material 100 and recording quality are selected. Examples of the types of the recording materials 200 and the transport material 100 include "plain paper" and "glossy paper"; examples of the recording quality include "normal" and "high". The controller 50 will reflect the selected recording quality in the printer 1 at Step S56. Based on the selected types, the controller 50 estimates the thicknesses of the recording materials 200 and the transport material 100. At Step S44, the user Su enters necessary setting data through the size entry screen and then clicks the "OK" button.

In response to the above, at Step S45, the controller 50 causes the operation panel 6 to a screen that encourages the user Su to place recording materials 200 on a platen 3*b* (see FIG. 1) of the scanner 3. The record confirmation screen may contain a message that encourages the user Su to place the recording material on the platen and click the "OK" button.

At Step S46, the user Su places the recording materials 200 on the platen 3*b* of the scanner 3 at any given locations and in any given orientation. At Step S47, the user Su clicks the "OK" button. In response, at Step S48, the controller 50 causes the scanner 3 to scan the recording material 200, thereby identifying the shape and size of the recording material 200 and the number of recording materials 200. Steps S49 to S56 to be subsequently performed are the same as Steps S15 to S22, respectively, in FIG. 6 and thus will not be described herein.

As described above, a printer 1 includes: a recording head 17, which serves as a recording unit that records data on a recording material 200; a feed roller pair 15 and an ejection roller pair 19, both of which serve as a transport unit that transports a transport material 100, the transport material 100 having a larger size than that of a recording material 200 at least in a transport direction; and a controller 50, which serves as a control unit that controls both the recording unit and the transport unit. The transport roller 13, the auxiliary roller 14, the pick roller 11, the inversion roller 20 may also serve as the transport unit that transports the transport material 100. The controller 50 is configured to operate in a first recording mode and in a second recording mode. In the first recording mode, the controller 50 acquires information regarding shapes and sizes of the recording material 200 and the transport material 100 and records a positioning pattern 110 on the transport material 100, the positioning pattern 110 being used to position the recording material 200 on the transport material 100. In the second recording mode, the controller 50 records the data on the recording material 200 positioned on the transport material 100, during transport of the transport material 100.

The above configuration successfully utilizes a general-purpose product, such as a plain paper or a similar sheet material, for the printing apparatus as the transport material without using a dedicated tray or adapter, thereby providing great convenience to a user at low product cost.

The printer 1 may further include a second medium detector 60, which is a detector disposed opposite the recording material 200. The controller 50 may record an identification pattern 111 within an inner area of the positioning pattern 110 during an operation in the first recording mode, may determine whether the identification pattern 111 is present with the second medium detector 60 before an operation in the second recording mode, and may cancel the operation in the second recording mode and perform an error process when determining that presence of the identification pattern 111. This configuration successfully reduces the risk of the transport material 100 being accidentally polluted or damaged when the recording material 200 is not bonded to the transport material 100.

During the operation in the first recording mode, the controller 50 may record an identification line L1 on the transport material 100. The identification line L1 may extend in a direction intersecting a transport direction so that a distance D1 differs from a distance D2, the distance D1 being defined as that between the identification line L1 and a front edge 100*a* of the transport material 100 in the transport direction, the distance D2 being defined as that between the identification line L1 and a rear edge 100*b* of the transport material 100 in the transport direction, and so that the identification line L1 is positioned nearer the front edge 100*a* than the positioning pattern 110. The controller 50 may detect a distance D3 between the identification line L1 and the front edge 100*a* of the transport material 100 before the operation in the second recording mode and, when a difference between the distances D1 and the distance D3 exceeds a predetermined allowable value, may suspend the operation in the second recording mode and may perform a predetermined process. This configuration can suppress the printer 1 from providing an improper recording result to a user, thereby reducing the risk of the transport material 100 being accidentally polluted or damaged or the recording material 200 being wasted.

The printer 1 may further include a plurality of transport routes along which the transport material 100 is to be transported. The controller 50 may acquire information regarding types of the recording material 200 and the transport material 100 and then may generate a UI that designates a suitable one of the transport routes, based on the acquired types of the recording materials 200 and the transport material 100. This configuration successfully transports the transport material 100 along an appropriate transport route, thereby providing a proper recording result.

Third Embodiment

Figure 9:
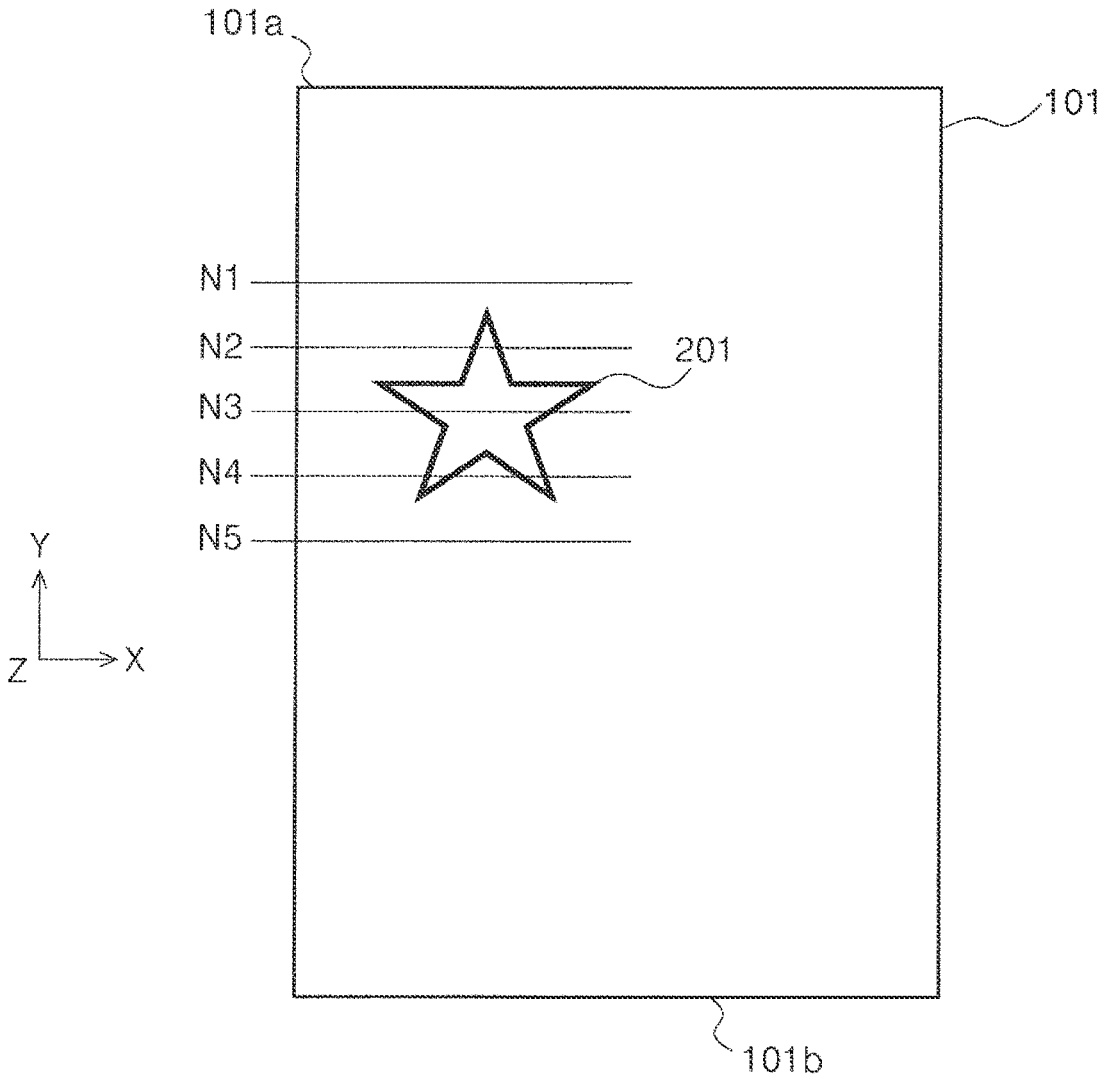
FIG. 9 is a plan view of an example of a transport material and a recording material to be used in a second embodiment of the present disclosure.
Figure 10:
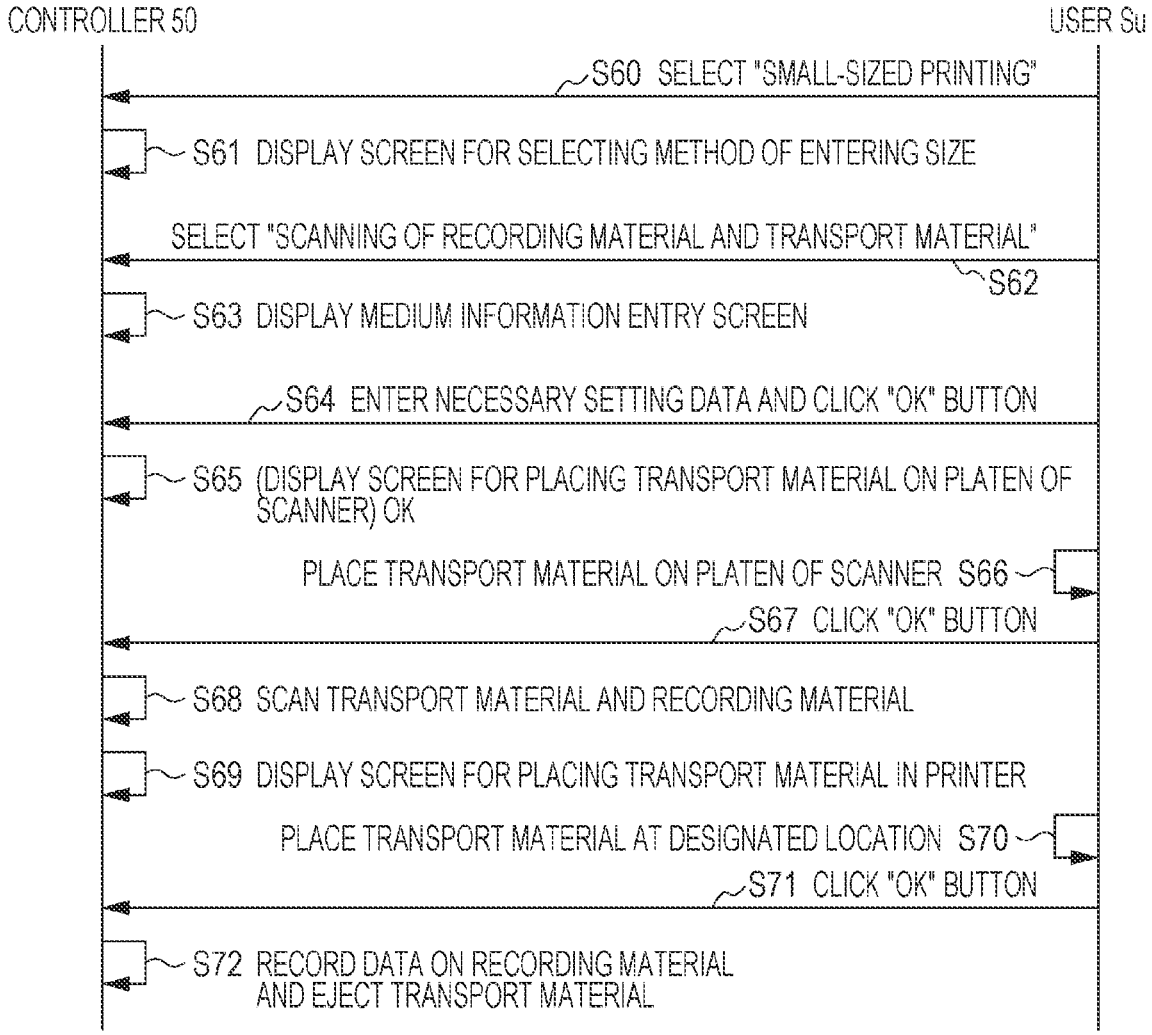
FIG. 10 is a sequence diagram of a control process according to a third embodiment of the present disclosure which the controller performs in response to user's operations.
Figure 11:
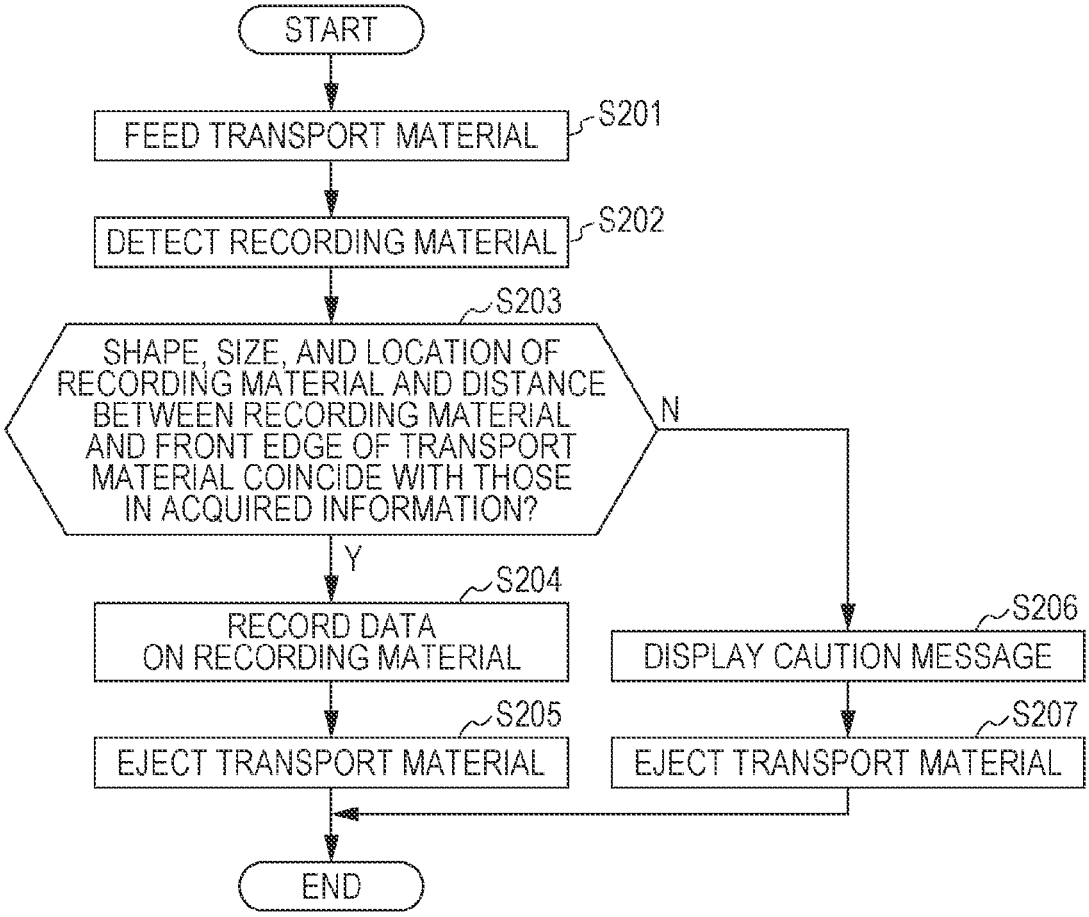
FIG. 11 is a flowchart of a control process according to the third embodiment which the controller performs.

With reference to FIGS. 9 to 11, a description will be given below of a third embodiment of the present disclosure, which is an example of a method of recording data on a recording material. In FIG. 9, the reference numeral 101 denotes further another example of a transport material, and the reference numeral 201 denotes an example of a recording material. The third embodiment differs from both the foregoing first and second embodiments in that a printer 1 scans recording materials 201 bonded to the transport material 101, thereby knowing the size and location of the recording material 201, the number of recording materials 201, and the shape and size of the transport material 101. This embodiment is applicable to the case where a recording material 201 does not have a specified size and shape, more specifically, the case where a recording material 201 has a complicated shape as in the foregoing second embodiment.

In FIG. 10, at Step S60, a user Su selects the "small-sized printing" through a UI in an operation panel 6. In response, at Step S61, a controller 50 causes the operation panel 6 to display a screen for selecting a method of entering a size.

The user Su can select a preferred one from the "manual entry", the "scanning of recording material", and the "scanning of recording material and transport material" through the screen for selecting a method of entering a size. In the third embodiment, at Step S62, the user Su selects the "scanning of recording material and transport material". In response, at Step S63, the controller 50 causes the operation panel 6 to display a screen for entering medium information through the user Su can enter medium information. The screen for entering medium information provides a UI through which the types of the recording material 201 and the transport material 101 and the size of the recording quality are defined. Examples of the types of the recording material 201 and the transport material 101 include "plain paper" and "glossy paper"; examples of the recording quality include "normal" and "high". Based on the selected types, the controller 50 estimates the thicknesses of the recording material 201 and the transport material 101. At Step S64, the user Su enters necessary setting data through the screen for entering medium information and then clicks the "OK" button.

In response to the above, at Step S65, the controller 50 causes the operation panel 6 to display a screen that encourages the user Su to place the transport material 101 on a platen 3*b* (see FIG. 1) of the scanner 3. This screen may contain a message reading "place transport material on platen with recording material bonded and click "OK" button".

At Step S66, the user Su places the transport material 101 on the platen 3*b* of the scanner 3. At Step S67, the user Su clicks the "OK" button. In response, at Step S68, the controller 50 causes the scanner 3 to scan both the transport material 101 and the recording material 201. The controller 50 thereby knows the size of the transport material 101, the shape and size of the recording material 201, the number of recording materials 201, and the location of the recording material 201 relative to the transport material 101. Herein, the operation at Step S67 corresponds to an operation in a mode of reading information regarding the shape and size of the recording material 201 and the location of the recording material 201 relative to the transport material 101.

At Step S69, the controller 50 causes the operation panel 6 to display a screen that encourages the user Su to place the transport material 101 in the printer 1. More specifically, the controller 50 encourages the user Su to place the transport material 101 at a location designated based on the types of the recording material 201 and the transport material 101. In this embodiment, the controller 50 acquires information regarding the types of the recording material 201 and the transport material 101 and then generates a UI that designates a suitable one of a plurality of transport routes, based on the acquired types of the recording material 200 and the transport material 100, as in the foregoing first and second embodiments. At Step S70, the user Su places the transport material 101 at the designated location. Then, at Step S71, the user Su clicks the "OK" button. In response, at Step S72, the controller 50 starts feeding the transport material 101, records data on the recording material 201, and ejects the transport material 101. Herein, the operation at Step S72 corresponds to an operation in a mode of recording data on the recording material 201 based on information acquired through an operation in the reading mode at Step S68.

With reference to FIG. 11, a description will be given below of a control process that the controller 50 performs in order to record data on the recording material 201. In response to an instruction of performing a recording operation at Step S71 in FIG. 10, at Step S201, the controller 50 starts feeding the transport material 100. At Step S202, the controller 50 uses a second medium detector 60 to detect the recording material 201. In this case, to detect the recording material 201, the second medium detector 60 may move along a plurality of lines, such as those denoted by N1 to N5 in FIG. 9, thereby scanning the entire area of the transport material 101 in which the recording material 201 is expected to be present. At Step S203, the controller 50 determines whether the shape, size, and location of the recording material 201 and the distance between the recording material 201 and the front edge of the transport material 101 in the transport direction coincide with those contained in information acquired in advance. If the second medium detector 60 fails to detect the recording material 201 within the expected present area of the transport material 101, the controller 50 may cause the second medium detector 60 to scan another area of the transport material 101, in which case the transport material 101 may be placed in a wrong orientation.

When determining that the shape, size, and location of the recording material 201 and the distance between the recording material 201 and the front edge of the transport material 101 in the transport direction do not coincide with those contained in the information acquired in advance as the result of Step S202 (No at Step S203), the controller 50 performs a predetermined process, in which case wrong transport material and recording material are placed. In this embodiment, the predetermined process is that the controller 50 causes the operation panel 6 to display a caution message at Step S206 and then ejects the transport material 101 at Step S207. This caution message may be a message reading "recording material and transport material are different from those scanned in advance". In this embodiment, the controller 50 suspends the recording of information on the recording material 201; however, the controller 50 will finally cancel the recording of the data on the recording material 201.

When determining that the shape, size, and location of the recording material 201 and the distance between the recording material 201 and the front edge of the transport material 101 in the transport direction coincide with those contained in the information acquired in advance as the result of Step S202 (Yes at Step S203), at Step S204, the controller 50 records data on the recording material 201. Then, at Step S205, the controller 50 ejects the transport material 101.

Before recording the data on the recording material 201, the controller 50 already knows the location of the recording material 201 relative to the transport material 101. Therefore, the controller 50 can use a first medium detector 59 or the second medium detector 60 to detect the front edge of the transport material 101 in the transport direction and then can record the data on the area of the transport material 101 in which the recording material 201 is expected to be present. In addition, the controller 50 may use the second medium detector 60 to further detect a side edge of the transport material 101 before recording the data on the area of the transport material 101 in which the recording material 201 is expected to be present. Alternatively, the controller 50 may use the second medium detector 60 to directly detect the recording material 201 and then may record the data, based on the detected location.

As described above, a printer 1 includes a controller 50 that can use a read sensor 3*c* in a scanner 3, which serves as a scanning unit, to acquire information regarding a shape and size of a recording material 201 and a transport material 101 and a location of the recording material 201 relative to the transport material 101. Then, during the transport of the transport material 101, the controller 50 can operate in a recoding mode in which data is recorded on the recording material 201 based on the acquired information. This configuration successfully utilizes a general-purpose product, such as a plain paper or other sheet material owned by a user, for the printer 1 as the transport material 100 without using a dedicated tray or adapter, thereby providing great convenience to a user at low product cost.

In the foregoing first to third embodiments, the scanning unit is implemented by a scanner 3 integrated into a printer 1; however, the scanning unit may be implemented by an external image reader connected to the printer 1 or a digital camera. Obviously, the digital camera may be disposed in a portable information terminal. If the digital camera is used as the scanning unit, the controller 50 may allow a user to set the size of the transport material 101 and then may calculate the shape and size of the recording material, the number of recording materials, and the location of the recording material relative to the transport material, based on the size of the transport material set by the user and captured image information.

In the foregoing first to third embodiments, a UI through which the user can enter setting parameters is implemented by an operation panel 6. However, if the user can operate the printer 1 by using a portable information terminal (not illustrated) that communicates with the printer 1, the UI may be implemented by a display unit (not illustrated) disposed in this portable information terminal.

Transport Method, Recording Method, and Method of Setting PG

With reference to FIG. 12, a description will be given below of a transport method, a recording method, and a method of setting the PG. FIG. 12 is a table that lists the relationship between each of a transport method, a recording method, and a PG and the combination of types of a recording material and a transport material. A controller 50 identifies a unique identifier of each of a recording material and a transport material, thereby determining which type it belongs to. Hereinafter, the "recording material" is assumed to be any of the above recording materials 200 and 201, whereas the "transport material" is assumed to be any of the above transport materials 100 and 101.

As can be seen from FIG. 12, the transport method depends on the type of the transport material. In this case, examples of factors to determine the transport method include: a speed at which individual rollers feed a transport material; a correction value used for a transport material; and the execution or nonexecution of skew correction. For example, if the type of a recording material is "a1" and the type of a transport material is "b1", the controller 50 selects the transport method related to the type b1. When performing the normal printing, the controller 50 switches the transport method depending on the type of a transport material, such as a plain or glossy paper. Likewise, when performing the small-sized printing, the controller 50 also switches the transport method depending on the type of a transport material. As an example, if the type of the transport material is a glossy paper that is more likely to slip over the rollers than a plain paper, the controller 50 may transport the transport material at a lower speed, with a higher correction value, and without a skew correction.

As can be seen from FIG. 12, the recording method depends on the type of the recording material. In this case, examples of factors to determine the recording method include: a recording scheme, such as a one-way recording scheme in which data is recorded on the recording material when a carriage 16 (see FIG. 1) moves only in one direction or a two-way recording scheme in which data is recorded on the recording material when the carriage 16 moves in both the directions; a process of discharging ink through nozzles; and a time needed for the ink to be dried. For example, if the type of a recording material is "a1" and the type of a transport material is "b1", the controller 50 selects the recording method related to the type a1.

As can be seen from FIG. 12, the PG depends on the types of both the recording material and the transport material. For example, if the type of a recording material is "a1" and the type of a transport material is "b1", the controller 50 selects the PG related to the total thickness of the recording material and the transport material.

In the example of FIG. 12, the controller 50 sets all of the transport method, the recording method, and the PG, depending on the types of the recording material and the transport material. Alternatively, the controller 50 may set only one or two of the transport method, the recording method, and the PG, depending on the types of the recording material and the transport material. In this way, the controller 50 acquires information regarding the types of the recording material and the transport material and then sets at least one of the transport method, the recording method, and the PG, depending on the types of the recording material and the transport material. This configuration successfully provides sufficiently high recording quality.

The present disclosure is not limited to the foregoing first to third embodiments and may undergo various modifications within the scopes of the claims. Those modifications obviously fall within the scope of the present disclosure.

What is claimed is:

1. A recording apparatus comprising:

a recording unit that records data on a recording material;

a transport unit that transports a transport material, the transport material having a larger size than that of the recording material at least in a transport direction; and a control unit that controls both the recording unit and the transport unit, wherein the control unit acquires information regarding shapes and sizes of the recording material and the transport material, and the control unit is configured to operate in a first recording mode in which a positioning pattern is recorded on the transport material, the positioning pattern being used to position the recording material on the transport material and to operate in a second recording mode in which the data is recorded on the recording material positioned on the transport material, during transport of the transport material.

2. The recording apparatus according to claim 1, further comprising a detector disposed opposite the transport material transported by the transport unit, wherein the control unit controls the recoding unit to record an identification pattern within an inner area of the positioning pattern during an operation in the first recording mode, determines whether the identification pattern is present, based on a detection result of the detector before an operation in the second recording mode, and when detecting the identification pattern, cancels the operation in the second recording mode and performs an error process.

3. The recording apparatus according to claim 2, wherein the control unit acquires information regarding types of the recording material and the transport material and sets at least one of a transport method performed by the transport unit, a recording method performed by the recording unit, and a distance between the recording unit and the recording material, based on the types of the recording material and the transport material.

4. The recording apparatus according to claim 2, further comprising a plurality of transport routes along which the transport material is to be transported, wherein the control unit acquires information regarding types of the recording material and the transport material and generates a user interface that designates a suitable one of the transport routes, based on the types of the recording material and the transport material.

5. The recording apparatus according to claim 1, further comprising a detector disposed opposite the transport material transported by the transport unit, wherein the control unit controls the recoding unit to record an identification line on the transport material during an operation in the first recording mode, the identification line extending in a direction intersecting the transport direction, the identification line is recorded so that a first distance between the identification line and a front edge of the transport material in the transport direction differs from a second distance between the identification line and a rear edge of the transport material in the transport direction and so that the identification line is positioned nearer the front edge than is the positioning pattern, the control unit determines a third distance between the identification line and the front edge of the transport material in the transport direction, based on a detection result of the detector, before an operation in the second recording mode, and when a difference between the first distance and the third distance exceeds an allowable value, the controller suspends the operation in the second recording mode and performs a predetermined process.

6. The recording apparatus according to claim 5, wherein the control unit acquires information regarding types of the recording material and the transport material and sets at least one of a transport method performed by the transport unit, a recording method performed by the recording unit, and a distance between the recording unit and the recording material, based on the types of the recording material and the transport material.

7. The recording apparatus according to claim 5, further comprising a plurality of transport routes along which the transport material is to be transported, wherein the control unit acquires information regarding types of the recording material and the transport material and generates a user interface that designates a suitable one of the transport routes, based on the types of the recording material and the transport material.

8. The recording apparatus according to claim 1, wherein the control unit acquires information regarding types of the recording material and the transport material and sets at least one of a transport method performed by the transport unit, a recording method performed by the recording unit, and a distance between the recording unit and the recording material, based on the types of the recording material and the transport material.

9. The recording apparatus according to claim 8, wherein the transport unit includes a feed roller pair that feeds the transport material to the recording unit and an ejection roller pair that ejects the transport material, and a length of the recording material in the transport direction is shorter than a distance between a nip point of the feed roller pair and a nip point of the ejection roller pair in the transport direction.

10. The recording apparatus according to claim 1, further comprising a plurality of transport routes along which the transport material is to be transported, wherein the control unit acquires information regarding types of the recording material and the transport material and generates a user interface that designates a suitable one of the transport routes, based on the types of the recording material and the transport material.

11. The recording apparatus according to claim 1, wherein the recording material is an optical disc, a card, or a seal.

12. The recording apparatus according to claim 1, wherein the transport unit includes a feed roller pair that feeds the transport material to the recording unit and an ejection roller pair that ejects the transport material, and a length of the recording material in the transport direction is shorter than a distance between a nip point of the feed roller pair and a nip point of the ejection roller pair in the transport direction.

13. A recording apparatus comprising:

a recording unit that records data on a recording material;

a transport unit that transports a transport material, the transport material having a larger size than that of the recording material at least in a transport direction;

a control unit that controls both the recording unit and the transport unit; and a scanning unit that scans the transport material on which the recording material is positioned, wherein the control unit acquires information regarding shapes and sizes of the recording material and the transport material and information regarding a position of the recording material relative to the transport material, based on scan information received from the scanning unit, and the control unit is configured to operate in a recording mode in which the data is recorded on the recording material based on the acquired information during transport of the transport material.

14. The recording apparatus according to claim 13, wherein the control unit acquires information regarding types of the recording material and the transport material and sets at least one of a transport method performed by the transport unit, a recording method performed by the recording unit, and a distance between the recording unit and the recording material, based on the types of the recording material and the transport material.

15. The recording apparatus according to claim 14, wherein the transport unit includes a feed roller pair that feeds the transport material to the recording unit and an ejection roller pair that ejects the transport material, and a length of the recording material in the transport direction is shorter than a distance between a nip point of the feed roller pair and a nip point of the ejection roller pair in the transport direction.

16. The recording apparatus according to claim 13, further comprising a plurality of transport routes along which the transport material is to be transported, wherein the control unit acquires information regarding types of the recording material and the transport material and generates a user interface that designates a suitable one of the transport routes, based on the types of the recording material and the transport material.

17. The recording apparatus according to claim 13, wherein the transport unit includes a feed roller pair that feeds the transport material to the recording unit and an ejection roller pair that ejects the transport material, and a length of the recording material in the transport direction is shorter than a distance between a nip point of the feed roller pair and a nip point of the ejection roller pair in the transport direction.

* * * * *